United States Patent [19]

Sakamaki et al.

[11] Patent Number: 4,799,867

[45] Date of Patent: Jan. 24, 1989

[54] VANE PUMP WITH BRITTLE VANES AND ROUGH FINISHED HOUSING SURFACE

[75] Inventors: Hiroshi Sakamaki; Yukio Horikoshi; Kenji Tanzawa, all of Sakado, Japan

[73] Assignee: Eagle Industry Co., Ltd., Tokyo, Japan

[21] Appl. No.: 118,100

[22] Filed: Nov. 6, 1987

[30] Foreign Application Priority Data

Nov. 21, 1986 [JP] Japan ..... 61-178289[U]

[51] Int. Cl.[4] ..... F04C 18/344; F04C 29/00

[52] U.S. Cl. ..... 418/1; 418/152; 418/178; 418/179; 418/257; 418/261

[58] Field of Search ..... 418/152, 257, 260, 261, 418/264, 178, 1, 179

[56] References Cited

U.S. PATENT DOCUMENTS

| | | | |
|---|---|---|---|
| 141,000 | 7/1873 | Gillespie | 418/257 |
| 1,444,269 | 2/1923 | Piatt | 418/257 |
| 2,492,935 | 12/1949 | McCulloch et al. | 418/178 |
| 2,519,557 | 8/1950 | Flanagan | 418/179 |
| 2,672,282 | 3/1954 | Novas | 418/152 |
| 3,433,166 | 3/1969 | Birkemeier | 418/152 |
| 3,988,083 | 10/1976 | Shimizu et al. | 418/264 |
| 4,212,603 | 7/1980 | Smolinski | 418/257 |
| 4,334,840 | 6/1982 | Teruyama | 418/1 |
| 4,466,785 | 8/1984 | Biswas | 418/178 |

*Primary Examiner*—John J. Vrablik

*Attorney, Agent, or Firm*—Jordan and Hamburg

[57] ABSTRACT

A vane pump in which an engaging portion in engagement with vanes to restrain the protrusion of the vanes to a given amount is provided on the inner surface of an end wall of a housing, the vanes being made of a material having a relatively high brittleness, the housing having an inner peripheral surface finished into a rough surface so as to restrain the sliding resistance of the vanes resulting from rotation thereof.

5 Claims, 2 Drawing Sheets

VANE PUMP WITH BRITTLE VANES AND ROUGH FINISHED HOUSING SURFACE

BACKGROUND OF THE INVENTION

The present invention relates to a vane pump, for example, a rotary pump used for various devices such as a supercharger of an engine, a compressor of a freezing cycle, etc.

A vane pump schematically shown in FIG. 4 has been heretofore widely known.

In FIG. 4, reference numeral 31 designates a housing, 32, a rotor inserted eccentrically into an inner peripheral space of the housing 31 and rotatably supported by a rotational shaft 33; 35*a*, 35*b* and 35*c*, plate-like vanes disposed radially retractably from vane grooves 34*a*, 34*b* and 34*c* equally spaced apart so as to peripherally divide the outer peripheral side of the rotor 32 into three sections. When the rotor 32 is rotated in the direction as indicated by the arrow X by the rotational shaft 33, the vanes 35*a*, 35*b* and 35*c* are moved out in the direction of the outside diameter by the centrifugal force, and the end edges thereof rotate while slidably contacting the inner peripheral surface of the housing 31. Since the rotor 32 is eccentric with respect to the housing 31 as previously mentioned, as such rotation occurs, volumes of working spaces 36*a*, 36*b* and 36*c* defined by the housing 31, the rotor 31 and the vanes 35*a*, 35*b* and 35*c* are repeatedly enlarged and contracted to allow a fluid taken in from the intake port 37 to be discharged out of an outlet port 38.

However, the above-described conventional vane pump has problems that since the vanes slidably move along the inner peripheral surface of the housing at high speeds, the efficiency of volume caused by the great power loss due to the sliding resistance and by the generation of high sliding heat unavoidably deteriorates; the vanes materially become worn; and the vanes are expanded due to the generation of sliding heat to produce a galling with the inner side surface of both end walls of the housing, and the like.

In view of those problems as noted above, it is an object of the present invention to enhance the efficiency of pump and enhance the durability.

SUMMARY OF THE INVENTION

A vane pump according to the present invention is characterized in that it has a construction such that engaging portions provided coaxial with the inner peripheral surface of a housing and rotatably internally of both end walls of the housing and engaging portions provided on vanes are brought into radial engagement with each other to define the protrusion of the vanes toward the inner peripheral surface of the housing, and that the vanes being made of a material having a relatively high brittleness, and the inner peripheral surface of the housing is subjected to rough finishing.

According to the present invention, the protrusion of the vanes caused by the centrifugal force is defined by the engagement between said both engaging portions and the vanes rotate in a state not in contact with the inner peripheral surface of the housing. In this case, since said engagement is accompanied by sliding, if the vane pump is used for a long period of time, both the engaging portions unavoidably wear with the lapse of time, and finally the end edges of the vanes contact the inner peripheral surface of the housing. However, the vanes are formed of a material having a relatively high brittleness and the inner peripheral surface of the housing is subjected to rough finishing, and therefore the contact portions of the end edges of the vanes instantaneously become abraded. Thus, the state in which a fine clearance close to zero is interposed between the vanes and the inner peripheral surface of the housing is maintained.

As described above, in the vane pump according to the present invention, the engaging portions such as retainers provided coaxial with the inner peripheral surface of the housing and rotatably internally of the both end walls of the housing and the engaging portions such as projections provided on the vanes are brought into contact with each other to define the protrusion of the vanes caused by the centrifugal force. Since the sliding between both the engaging portions resulting from said engagement is small, it is possible to prevent the lowering of the pump efficiency due to the sliding resistance and high heat generation caused by sliding and the early advance of wear, and to lower the temperature of the fluid discharged out of the pump as compared with prior art. In addition, it is so designed that even if the end edges of the vanes should contact with the inner peripheral surface of the housing due to the wear of said engaging portions with the lapse of time, the contact portions of the end edges become instantaneously abraded, and therefore it is possible to prevent an increase of sliding resistance and heat generation and maintain the excellent performance of the pump, thus providing an extremely great practical effect.

While the present invention has been briefly outlined, the above and other objects and new features of the present invention will be fully understood from the reading of the ensuing detailed description in conjunction with embodiments shown in the accompanying drawings. It is to be noted that the drawings are exclusively used to show one embodiment for the understanding of the present invention and are not intended to limit the scope of this invention.

DESCRIPTION OF THE PREFERRED EMBODIMENTS

An embodiment of a vane pump according to the present invention will be described hereinafter with reference to the drawings.

Figure 1:
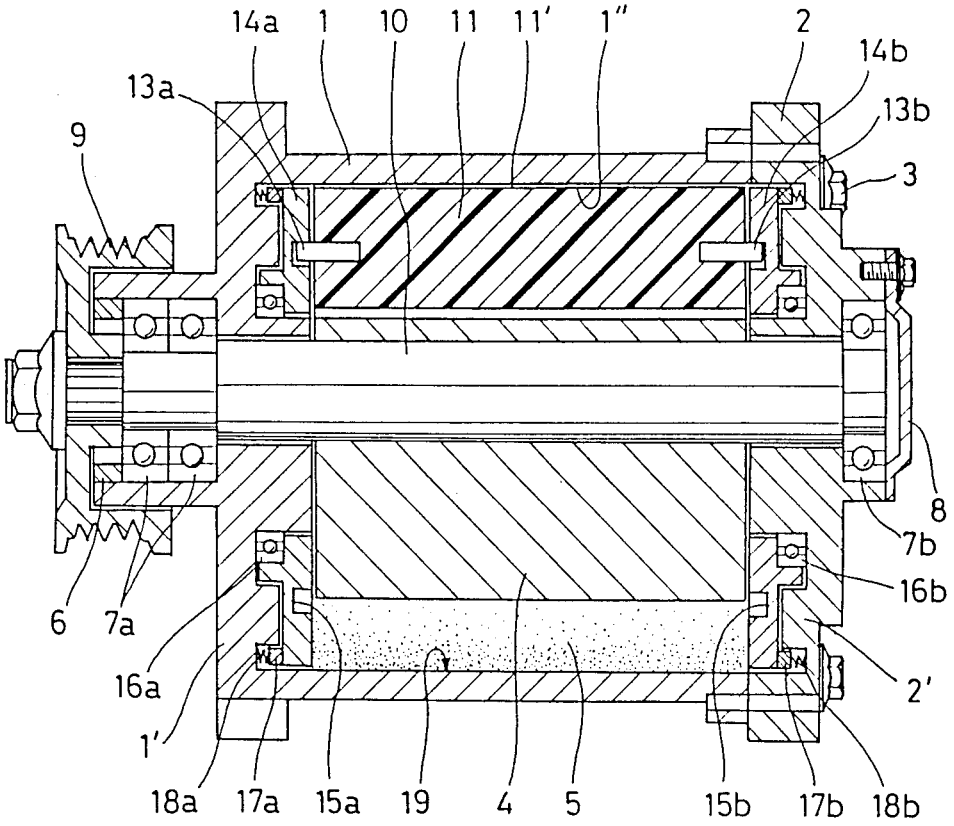
FIG. 1 is a side sectional view showing one embodiment of a vane pump according to the present invention.
Figure 2:
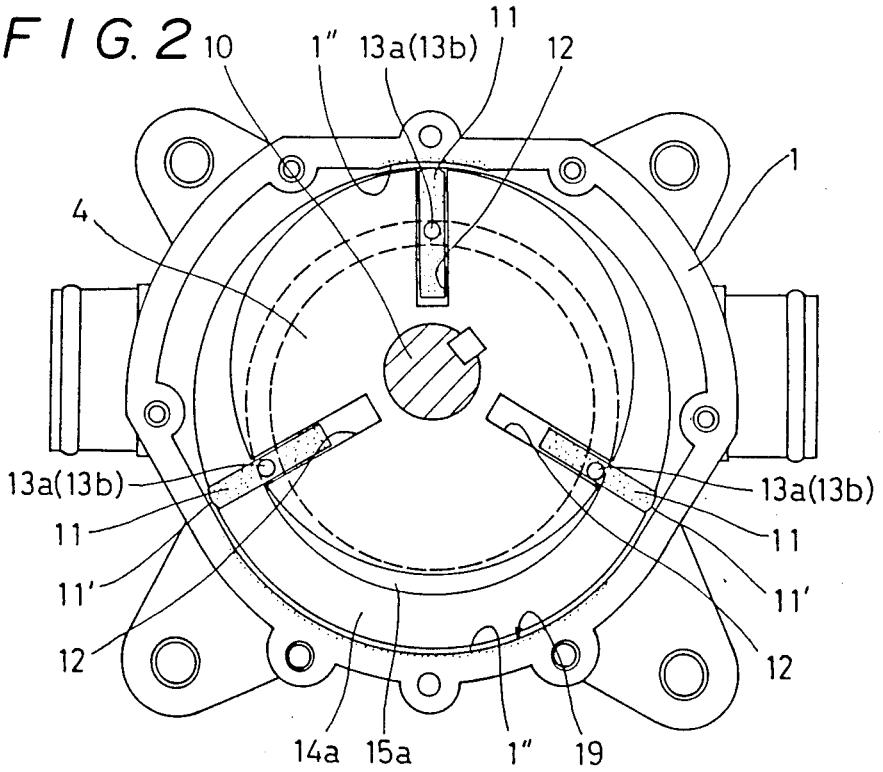
FIG. 2 is likewise an explanatory view of an internal construction as viewed in an axial direction.
Figure 4:
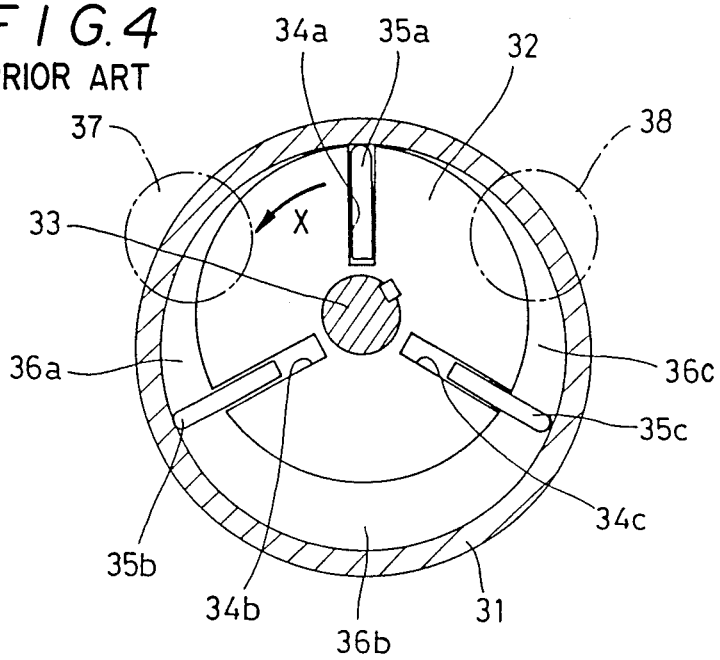
FIG. 4 PRIOR ART
FIG. 4 is a front sectional view showing a schematic construction of a conventional vane pump.

FIGS. 1 and 2 showing a first embodiment, a front housing 1 and a rear housing 2, which both housings are made of non-ferrous metal such as aluminum which is light in weight and is small in the coefficient of thermal expansion, are secured integral with each other by means of bolts 3. A rotor 4 made of iron eccentrically inserted into an inner peripheral space 5 of the housing is extended through both the housings 1 and 2 through a ball bearing 7*a* held by a fixed ring 6 in anti-slipout fashion in an axial shoulder of the front housing 1 and a ball bearing 7*b* held by a bearing cover 8 in anti-slipout fashion in an axial shoulder of the rear housing 2 and is rotatably mounted on a rotational shaft 10 to which a drive force is transmitted from a pulley 9. Reference numeral 11 designates plate-like vanes made of a carbon material which is excellent in slidability and has a relatively high brittleness, the vanes being disposed so that they may be radially projected and retracted (slidably) into vane grooves 12 disposed in equally spaced relation in a manner such that the outer peripheral side of the rotor 4 is peripherally divided into three sections. Projections 13*a* and 13*b* as engaging portions are provided on both side ends axially of each of the vanes, and sliding members (not shown) made of resin which is excellent in slidability and wear resistance are slipped over the projections 13*a* and 13*a* as needed. Internally of end walls 1' and 2' of the front housing 1 and the rear housing 2, retainers 14*a* and 14*b* formed of light metal such as aluminum and coaxially formed with annular grooves 15*a* and 15*b* as engaging portions are rotatably mounted in annular recesses formed coaxial with an inner peripheral surface 1'' of the front housing 1 (hereinafter referred to as the inner peripheral surface of the housing) through ball bearings 16*a* and 16*b*. The projections 13*a* and 13*b* provided on each of the vanes 11 are loosely fitted peripherally slidably in the annular grooves 15*a* and 15*b* and radially engaged therewith. This engagement defines the protrusion of the vanes 11 caused by the centrifugal force during rotation of the vanes, and the state in which a fine clearance is always interposed between the end edge 11' thereof and the inner peripheral surface 1'' of the housing is maintained. Reference numerals 17*a* and 17*b* designate backup rings which are axially urged by springs 18*a* and 18*b* provided in peripherally equally spaced positions and are in sliding contact with the back surfaces of the retainers 14*a* and 14*b*. The retainers 14*a* and 14*b* are formed of a material such as resin which is excellent is slidability and has the function to prevent the retainers 14*a* and 14*b* and the vanes from their axial deflection.

Figure 3:
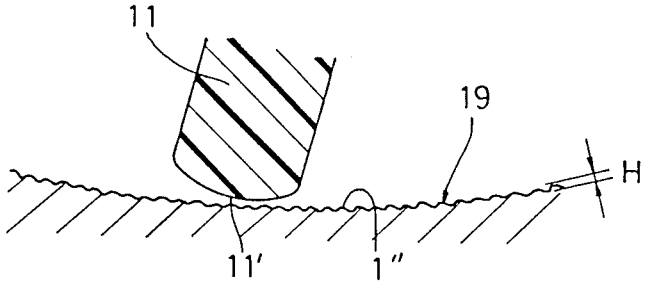
FIG. 3 is likewise an enlarged sectional view of the essential parts.

The inner peripheral surface 1'' of the housing is subjected to rough finishing 19 whose surface roughness H is at least 10 $\mu$ or more, as shown in FIG. 3 in an enlarged scale, by blast process using steel grains, or chemical polishing using anodic acid and the like.

With the above-described arrangement, when the rotational shaft 10 and the rotor 4 are rotated by the drive force from the pulley 9, the vanes 11 rotate accordingly, and the projections 13*a* and 13*b* provided on both the side ends thereof are rotated within the annular grooves 15*a* and 15*b* while contacting the inner surfaces on the outer peripheral sides of the annular grooves 15*a* and 15*b* by the centrifugal force acting on the vanes 11. The retainers 14*a* and 14*b* and the rotor 4 are approximately synchronously rotated by the frictional force between the projections 13*a*, 13*b* and the annular grooves 15*a*, 15*b*. Since the inner peripheral surface 1'' of the housing and the annular grooves 15*a* and 15*b* are in the coaxial relation and the annular grooves 15*a* and 15*b* and the rotor 4 are in the eccentric relation, as the aforesaid rotation takes place, the vanes 11 are radially slidably moved in the vane grooves 12 of the rotor 4 and repeatedly projected and retracted to repeatedly increase or decrease the volume of the working space defined by the rotor 4 and the vanes 11 to produce intake pressure and discharge pressure.

In the aforementined series of operations, the vanes 11 rotate in a state not in contact with the inner peripheral surface 1'' of the housing by the engagement between the projections 13*a*, 13*b* and annular grooves 15*a*, 15*b* and both the side ends of the vanes 11 are not in contact with the both end walls 1' and 2' of the housing through the presence of the retainers 14*a* and 14*b*, and therefore, no sliding torque, high sliding heat, and early advance of wear, etc. occur. Since the retainers 14*a* and 14*b* are rotated approximately in synchronism with the rotor 4, the relative sliding speed between the projections 13*a* and 13*b* of the vanes and the annular grooves 15*a* and 15*b* is small.

Incidentally, since the engagement between the projections 13*a* and 13*b* as the means for defining the protrusion of the vanes 11 and the annular grooves 15*a* and 15*b* is accompanied by the sliding, the sliding portion will unavoidably wear with the lapse of time due to the use for a long period of time even though the relative sliding speed is small. For this reason, as these projections 13*a*, 13*b* and annular grooves 15*a*, 15*b* wear each other, the locus of the end edge 11' of the vane gradually comes close to the inner peripheral surface 1'' of the housing, and finally they become contacted. At this time, since the inner peripheral surface 1'' of the housing is subjected to rough finishing 19 whose surface roughness H is 10 $\mu$ or more, the contact portion between the end edge 11' of the vane 11 formed of a carbon material having a relatively high brittleness and the inner peripheral surface 1'' of the housing instantaneously becomes abraded, and a state in which a fine clearance close to zero is present relative to the inner peripheral surface 1'' of the housing is maintained. Accordingly, the end edge 11' of the vane is not urged against the the inner peripheral surface 1'' of the housing by the centrifugal force and rotated, and the deterioration of the efficiency of the pump due to the increase in the sliding resistance and the amount of heat generation can be prevented.

While the above-described embodiment has a construction in which the retainers are rotated approximately synchronously with the rotor by the frictional force resulting from the engagement between the projections of the vanes and the annular grooves, it is to be noted that the rotor and the retainers may be connected by cams, in which case, the retainers rotate completely in synchronism with the rotor, and therefore the projections of the vanes are merely slided within the annular grooves in the range of the length about twice of the eccentric amount of the rotor. Thus, circular grooves corresponding to the aforesaid range can be formed in the retainers in place of the annular grooves.

Furthermore, as means for defining the appearance of the vanes toward the inner peripheral surface of the housing, there are various modes which include, in addition to the above, means wherein in place of the retainers, bearings are provided rotatably and coaxial with the inner peripheral surface of the housing internally of both the end walls of the housing and the projections of the vanes come into sliding contact with the inner peripheral surface of the bearings, or means wherein stoppers are formed on the outer peripheral ends of the retainers and the end edges of the vanes come into sliding engagement with the stoppers, and the like. In any of these examples, it can be designed so that the end edges of the vanes become instantaneously abraded by the contact thereof with the inner peripheral surface of the housing.

While we have described the preferred embodiment of the present invention, it will be obvious that various other modifications can be made without departing the principle of the present invention. Accordingly, it is desired that all the modifications that may substantially obtain the effect of the present invention through the use of the structure substantially identical with or corresponding to the present invention are included in the scope of the present invention by the appended claim.

What is claimed is:

1. A method of operating a vane pump of the type having a housing with a rotor chamber having an inner peripheral surface, a rotor rotatably mounted in the rotor chamber and having an axis of rotatation which is eccentric relative to the axis of the inner peripheral surface of the rotor chamber, the rotor having a plurality of generally radially disposed vane slots, and a plurality of vanes slidable mounted in the vane slots and operable to define variable volume chambers for effecting a pumping action as the rotor rotates and the vanes move generally radially in and out of the vane slots, the method of operation comprising the steps of limiting the radial outward movement of said vanes from said vane slots to provide a minimal near-zero clearance between the outer radial ends of said vanes and the inner peripheral surface of said rotor chamber, providing a roughened surface on said inner peripheral surface of said rotor chamber, operating said vane pump with said minimal near-zero clearance between the outer radial ends of said vanes and the inner peripheral roughened surface of said rotor chamber, continuing to operate said vane pump over a prolonged period of time to the extent that wear occurs and that as a result of said wear, said minimal near-zero clearance between the outer radial ends of said vanes and the inner peripheral roughened surface of said rotor chamber is reduced to zero, and immediately abrading said outer radial ends of said vanes by contact with said roughened surface such that said minimal near-zero clearance is reestablished between the outer radial ends of said vanes and the inner peripheral surface of said rotor chamber.

2. A vane pump comprising a housing means having a rotor chamber, said rotor chamber having an inner peripheral surface, a rotor means rotatably mounted in said rotor chamber, said inner peripheral surface having an axis which is eccentric relative to the axis of rotation of said rotor means, said rotor means having a plurality of generally radially disposed vane slots, a plurality of vane means slidably mounted in said vane slots and operable to define variable volume chambers for effecting a pumping action as said rotor means rotates and said vane means moves generally radially in and out of said vane slots, vane-limiting means in said housing means operable to engage said vane means to limit the extent of the outer radial movement of said vane means out of said slots to thereby provide a clearance between the outer radial ends of said vane means and said inner peripheral surface of said rotor chamber, said vane means being made of a brittle material, said housing means being made of a metal material, said inner peripheral surface of said rotor chamber being a roughened metal surface formed in the metal material of said housing means such that when wear occurs in said vane-limiting means after prolonged operation of the vane pump to the extent that said vane means extend further radially outwardly of said slots to the extent of said clearance as a result of said wear to contact said roughened metal surface, said brittle vane means are immediately abraded by said roughened metal surface to thereby establish a minimal near-zero operating clearance between said brittle vane means and said roughened metal surface.

3. A vane pump according to claim 2, wherein said roughened surface has a depth of at least 10 $\mu$.

4. A vane pump according to claim 2, wherein said vane means are made of a carbon material.

5. A vane pump according to claim 2, wherein said housing means is made of aluminum.

* * * * *